US010662733B2

(12) United States Patent
Meikle

(10) Patent No.: US 10,662,733 B2
(45) Date of Patent: May 26, 2020

(54) FILLING MECHANISM FOR A MORPHABLE SLEEVE

(71) Applicant: Meta Downhole Limited, Aberdeen (GB)

(72) Inventor: Duncan James Meikle, Aberdeen (GB)

(73) Assignee: MORPHPACKERS LIMITED (GB)

( * ) Notice: Subject to any disclaimer, the term of this patent is extended or adjusted under 35 U.S.C. 154(b) by 410 days.

(21) Appl. No.: 14/911,664

(22) PCT Filed: Aug. 18, 2014

(86) PCT No.: PCT/GB2014/052519
§ 371 (c)(1),
(2) Date: Feb. 11, 2016

(87) PCT Pub. No.: WO2015/022552
PCT Pub. Date: Feb. 19, 2015

(65) Prior Publication Data

US 2016/0194931 A1 Jul. 7, 2016

(30) Foreign Application Priority Data

Aug. 16, 2013 (GB) ..... 1314665.9

(51) Int. Cl.
*E21B 33/12* (2006.01)
*E21B 33/127* (2006.01)
*E21B 33/124* (2006.01)

(52) U.S. Cl.
CPC ..... *E21B 33/127* (2013.01); *E21B 33/1243* (2013.01); *E21B 33/1277* (2013.01)

(58) Field of Classification Search
CPC ..... E21B 33/1243; E21B 33/127; E21B 33/1277; E21B 33/124; E21B 34/12; E21B 34/14
See application file for complete search history.

(56) References Cited

U.S. PATENT DOCUMENTS 2,835,329 A * 5/1958 True ..... E21B 33/1208 166/202
4,499,947 A * 2/1985 Zsoka ..... E21B 33/127 166/179

(Continued)

FOREIGN PATENT DOCUMENTS

GB 2398312 A 8/2004

OTHER PUBLICATIONS

Intellectual Property Office of the UK Patent Office; Search Report for GB1314665.9; dated Jan. 24, 2014; entire document; UK Patent Office, United Kingdom.

(Continued)

*Primary Examiner* — Robert E Fuller
*Assistant Examiner* — Christopher J Sebesta
(74) *Attorney, Agent, or Firm* — Law Office of Jesse D. Lambert, LLC

(57) ABSTRACT

Apparatus and method for filling and sealing a chamber with fluid at a predetermined pressure in a well bore. In a downhole assembly (10) comprising a tubular body (14) having a cylindrical throughbore (18) and a chamber (16) to be filled on an outer surface (26) of the body, a fill mechanism is provided to control fluid flow between the throughbore and the chamber. The fill mechanism includes a sliding seal (72) arrangement at the outer surface which is operated by the fluid flow in the throughbore to allow fluid flow into the chamber and then seal the chamber. Embodiments are described where the chamber is between a morphable sleeve (64) and the outer surface of the tubular, filling of the chamber morphs the sleeve and sealing the chamber at a predetermined fluid pressure secures the tubular within a borehole, creates an annular seal across an annulus or centralizes the tubing within a wellbore.

9 Claims, 2 Drawing Sheets

(56) References Cited

U.S. PATENT DOCUMENTS

Figure 1:
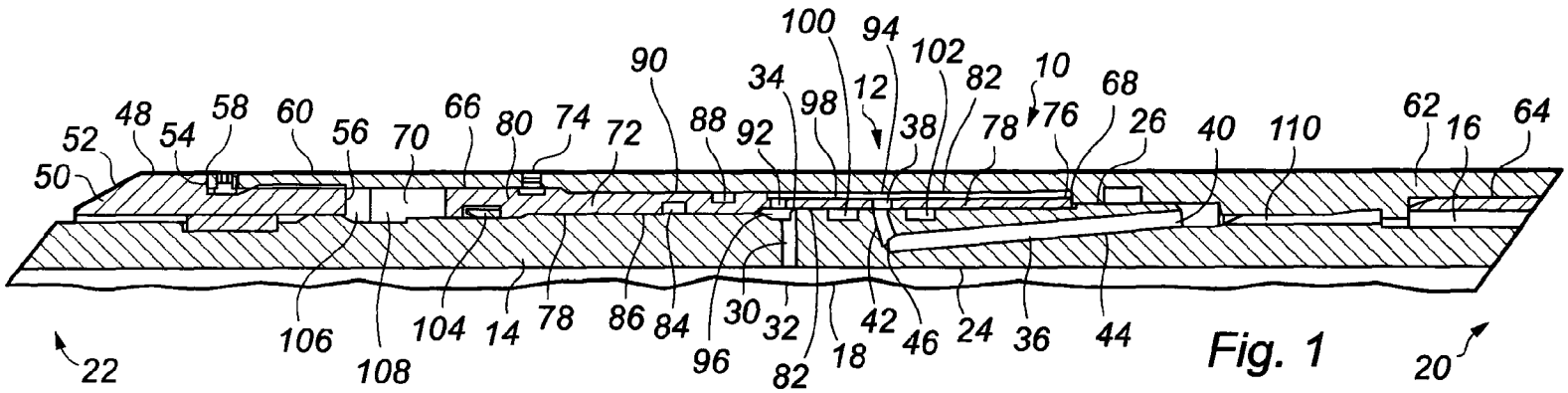

| | | | | |
|---|---|---|---|---|
| 4,653,588 | A * | 3/1987 | White | E21B 33/127 166/187 |
| 4,941,534 | A * | 7/1990 | Berzin | E21B 33/127 166/187 |
| 5,400,855 | A | 3/1995 | Stepp et al. | |
| 7,306,033 | B2 * | 12/2007 | Gorrara | E21B 33/12 166/187 |
| 8,291,984 | B2 | 10/2012 | Saltel | |
| 2005/0011678 | A1 * | 1/2005 | Akinlade | E21B 21/003 175/72 |
| 2005/0016740 | A1 * | 1/2005 | Aldaz | E21B 33/1246 166/387 |
| 2005/0133216 | A1 | 6/2005 | Bartlett | |
| 2011/0266004 | A1 | 11/2011 | Hallundbaek et al. | |
| 2012/0305243 | A1 | 12/2012 | Hallundbaek et al. | |
| 2014/0216755 | A1 * | 8/2014 | Hallundæk | E21B 23/06 166/373 |
| 2014/0262251 | A1 * | 9/2014 | O'Malley | E21B 33/1277 166/255.1 |

OTHER PUBLICATIONS

European Patent Office as Int'l Search Authority; International Search Report for PCT/GB2014/052519; dated Apr. 1, 2015; entire document; European Patent Office, Netherlands.

* cited by examiner

FILLING MECHANISM FOR A MORPHABLE SLEEVE

The present invention relates to an apparatus and method for filling and sealing a chamber with fluid at a predetermined pressure in a well bore and in particular, though not exclusively, to hydraulically morphing a sleeve on a tubular to secure the tubular within a borehole, create an annular seal across an annulus in a well bore or centralise the tubing within a wellbore, by filling a chamber of the sleeve with fluid and sealing the chamber at a predetermined fluid pressure.

In the exploration and production of oil and gas wells, packers are typically used to isolate one section of a downhole annulus from another section of the downhole annulus. The annulus may be between tubular members, such as a liner, mandrel, production tubing and casing or between a tubular member, typically casing, and the wall of an open borehole. These packers are carried into the well on tubing and at the desired location, elastomeric seals are urged radially outwards or elastomeric bladders are inflated to cross the annulus and create an annular seal with the outer generally cylindrical structure i.e. another tubular member or the borehole wall. These elastomers have disadvantages, particularly when chemical injection techniques are used.

As a result, metal seals have been developed, where a tubular metal member is run in the well and at the desired location, an expander tool is run through the member. The expander tool typically has a forward cone with a body whose diameter is sized to the generally cylindrical structure so that the metal member is expanded to contact and seal against the cylindrical structure. These so-called expanded sleeves have an internal surface which, when expanded, is cylindrical and matches the profile of the expander tool. These sleeves work well in creating annular seals between tubular members but can have problems in sealing against the irregular surface of an open borehole.

The present applicants have developed a technology where a metal sleeve is forced radially outwardly by the use of fluid pressure acting directly on the sleeve. Sufficient hydraulic fluid pressure is applied to move the sleeve outwards and cause the sleeve to morph itself onto the generally cylindrical structure. The sleeve undergoes plastic deformation and, if morphed to a cylindrical metal structure, the metal structure will undergo elastic deformation to expand by a small percentage as contact is made. When the pressure is released the metal structure returns to its original dimensions and will create an annular seal against the plastically deformed sleeve. During the morphing process, the inner surface of the sleeve will take up the shape of the surface of the wall of the cylindrical structure. This morphed isolation barrier is therefore ideally suited for creating an annular seal against an irregular borehole wall.

Such a morphed isolation barrier is disclosed in U.S. Pat. No. 7,306,033, which is incorporated herein by reference. An application of the morphed isolation barrier for FRAC operations is disclosed in US2012/0125619, which is incorporated herein by reference. Typically, the sleeve is mounted around a supporting tubular body, being fixed at each end of the sleeve to create a chamber between the inner surface of the sleeve and the outer surface of the body. A port is arranged through the body so that fluid can be pumped into the chamber from the throughbore of the body.

In use, the pressure of fluid in the throughbore is increased sufficiently to enter the chamber and force the sleeve outwardly to morph to the generally cylindrical structure. Sufficient pressure has been applied when there is no return of fluid up the annulus which verifies that an annular seal has been achieved. Though the sleeve has been plastically deformed and will therefore hold its new shape, if a sufficient pressure differential is created across the sleeve wall, there is a possibility that fracture can occur and the seal may be lost.

In one application, the pressure of fluid in the throughbore is maintained to keep a high pressure in the chamber. Indeed most sleeves are set by applying maximum pressure to the sleeve. Unfortunately, there is a risk that the pressure could be high enough to rupture the sleeve. Additionally, if the pressure differential acts in the opposite direction by a pressure drop in the throughbore or by an increase in fluid pressure in the annulus below the sleeve, the sleeve can be forced away from the cylindrical structure, causing loss of the annular seal.

To overcome this, a check valve is used in the port. This check valve is arranged to stop fluid returning to the throughbore. Application of sufficient fluid pressure will cause fluid to enter the chamber through the valve and the sleeve morphs to the cylindrical structure. When the annular seal is achieved, the pressure can be bled off to leave fluid at a trapped pressure within the chamber. This allows an isolation barrier to be created which does not need a constant fluid supply to maintain it in the sealed position.

A known disadvantage of this system is that typical check valves which operate via a ball or a flap can trap debris between the sealing surfaces as they close. This prevents a perfect seal and thus fluid can enter or exit the chamber resulting in the disadvantages as described hereinbefore. It must also be remembered that the annular seal is expected to provide an isolation barrier for the life of the well. Therefore what may appear as a negligible or undetectable leak at the check valve on closure will cause failure of the annular sleeve at a later date when pressure differentials vary between the chamber and throughbore over time and operations in the well.

To overcome these disadvantages a sliding sleeve can be used to create a seal across the port when a predetermined pressure has been reached. The sliding sleeve is mounted within the throughbore and an actuation mechanism used to move the sleeve longitudinally along the throughbore until the sleeve is positioned over the port. While this arrangement typically provides one or more o-rings which are used to both clean the sealing surface of the sleeve and create the seal round the port, the arrangement has its own disadvantages. As the arrangement is mounted in the throughbore, this can obstruct or at least restrict the fluid flow through the tubular body interfering with operation of the well. Additionally, the sleeve must be actuated and held in a sealed position. This is likely to require further apparatus in the throughbore and/or controls to the surface which can also obstruct the throughbore and increase well construction costs.

It is therefore an object of at least one embodiment of the present invention to provide a downhole assembly with a fill mechanism which obviates or mitigates one or more disadvantages of the prior art.

It is a further object of at least one embodiment of the present invention to provide a method of expanding a morphable sleeve in a well bore which obviates or mitigates one or more disadvantages of the prior art.

According to a first aspect of the present invention there is provided a downhole assembly, the assembly comprising a tubular body having a cylindrical throughbore, a chamber at an outer surface thereof and a fill mechanism to control fluid flow between the throughbore and the chamber, the fill mechanism comprising at least one fluid passageway through the tubular body and a sliding seal arrangement at the outer surface, the sliding seal having a sealing surface to provide a seal on the outer surface and prevent fluid flow from the throughbore to the chamber and wherein the sliding seal arrangement is operated by the fluid flow via a first fluid passageway through the tubular body.

In this way, the disadvantages of a check or flapper valve are avoided and there is no obstruction of the throughbore.

Preferably, the sealing surface is co-linear with a central, longitudinal axis of the tubular body. In this way, the downhole assembly can be thin-walled to provide a throughbore of maximum possible diameter.

Preferably, there are first and second fluid passageways through the body. Preferably, the first fluid passageway is a conduit through the body between a first port at an inner surface of the tubular body and a second port at the outer surface of the tubular body. Preferably the second fluid passageway is a conduit through the body between a third port at an outer surface of the tubular body and a fourth port at the outer surface of the tubular body, the third and fourth ports being spaced apart longitudinally on the outer surface of the body. In this way, the throughbore can be kept clear of obstructions only requiring a first port at the outer surface of the throughbore.

There may be a plurality of first fluid passageways. There may be a plurality of second fluid passageways. Preferably the plurality of fluid passageways are equidistantly arranged circumferentially around the longitudinal axis. In this way, the conduits may be narrow in diameter to ease machining thereof but a sufficient volume of fluid flow can be achieved through the body to fill the chamber.

Preferably, a housing is located on the outer surface wherein the second port exits into the housing and the sealing surface is arranged in the housing. The housing may be a sleeve around the body and the sliding seal may be a sliding sleeve. Alternatively the housing may be local to the second port with the sliding seal being a piston arranged in the housing. In this way, the sliding seal is contained so that fluid may act upon it.

Preferably, the third port exits from the housing and fluid exiting the fourth port is used to fill the chamber. The fourth port may exit directly into the chamber. Alternatively, there may be a third fluid passageway from the fourth port to the chamber. In this way, the fill mechanism can be spaced longitudinally apart from the chamber. By separating the housing and the chamber the downhole assembly can be thin walled to aid deployment into a well bore.

Advantageously, the sliding seal is arranged in the housing in a first configuration wherein fluid can flow from the second port to the third port to fill the chamber and a second configuration wherein the sealing surface seals a port to prevent fluid flow to the chamber. Preferably, in the second configuration the sealing surface seals the third port. In this way, a fixed fluid pressure can be retained in the chamber.

More preferably, the sliding seal moves between the first configuration and the second configuration by the action of fluid pressure against an end surface of the sliding seal. Thus the sealing arrangement can be actuated by fluid flow through the first passageway from the throughbore.

Preferably, the fill mechanism includes retaining means to hold the sliding seal in the first configuration. The retaining means may be a shear pin. In this way, the sliding seal can close the passageway to the chamber at a preselected fluid pressure.

Preferably, the fill mechanism includes locking means to keep the sliding seal in the second configuration. The locking means may be a locking ring on the sliding seal which engages in a recess in the housing. In this way, the chamber is sealed at a preselected fluid pressure for the life of the well.

Advantageously, the housing is formed between the outer surface of the tubular body and an inner surface of a sleeve arranged around the tubular body. An end of the sleeve may abut or include the chamber. In this way, the assembly is simple to construct.

Preferably the chamber is formed between the outer surface of the tubular body and a morphable sleeve arranged around the tubular body. Fastening means may be present at longitudinal ends of the chamber to hold the morphable sleeve to the tubular body. In this way, the downhole assembly can be an isolation barrier, anchor or centraliser.

According to a second aspect of the present invention there is provided a method of expanding a morphable sleeve in a well, comprising the steps:

(a) mounting a downhole assembly according to the first aspect on a tubular string, the fill mechanism being longitudinally spaced from the chamber and the chamber being formed between the morphable sleeve and the outer surface of the tubular body;
(b) retaining the sliding seal in a first configuration to provide a fluid flow path between the throughbore and the chamber;
(c) running the assembly on the tubing string into a well;
(d) increasing fluid pressure in the throughbore to fill the chamber;
(e) using the fluid in the chamber to radially move the morphable sleeve away from the tubular body and morph to a wall in the well bore creating an annular seal between the tubular string and the wall;
(f) releasing the sliding seal at a preselected fluid pressure;
(g) moving the sliding seal longitudinally over the outer surface of the body to seal the passageway to the chamber;
(h) locking the sliding seal in a second configuration to seal the chamber at the preselected fluid pressure; and
(i) maintaining the annular seal to prevent fluid flow past the assembly between the tubular string and the wall of the well bore.

In this way, the morphable sleeve is expanded to bridge the annulus between the tubular string and the wall of the wellbore. Thus the method may include the step of anchoring the tubular body to the wall of the well bore. Alternatively or additionally, the method may include the step of centralising the tubular body with respect to the wall of the well bore. Alternatively or additionally, the method may include the step of creating an isolation barrier between the tubular body and the wall of the well bore to prevent fluid flow in the annulus.

The method may include the step of running a setting tool through the tubular string to the assembly; sealing the tool, at upper and lower seals straddling the port, to the inner surface of the tubular body; injecting fluid into the tool between the seals to increase fluid pressure in the throughbore at the port to fill the chamber. The method may also include the step of removing the setting tool from the well. In this way, the fluid pressure can be increased independently at the assembly, so that an annular seal can be created at a desired time and without the risk of actuating other fluid pressure operated mechanisms in the well bore.

Preferably, the method includes the step of monitoring fluid flow in the annulus and determining that an annular seal has been created when fluid flow stops. In this way, the annular seal can be tested.

The wall of the well bore may be a borehole wall or the inner surface of another tubular located in the well, such as casing or liner.

The tubular string may be a drill string, production string or any other arrangement of tubulars deployed in a well.

There may be a plurality of downhole assemblies on the tubular string to be operated in the well bore. The downhole assemblies may operate at the same preselected fluid pressure or may operate at different preselected fluid pressures so that annular seals can be created in sequence. Annular seals may also be created in sequence by use of a setting tool.

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof.

Figure 2:
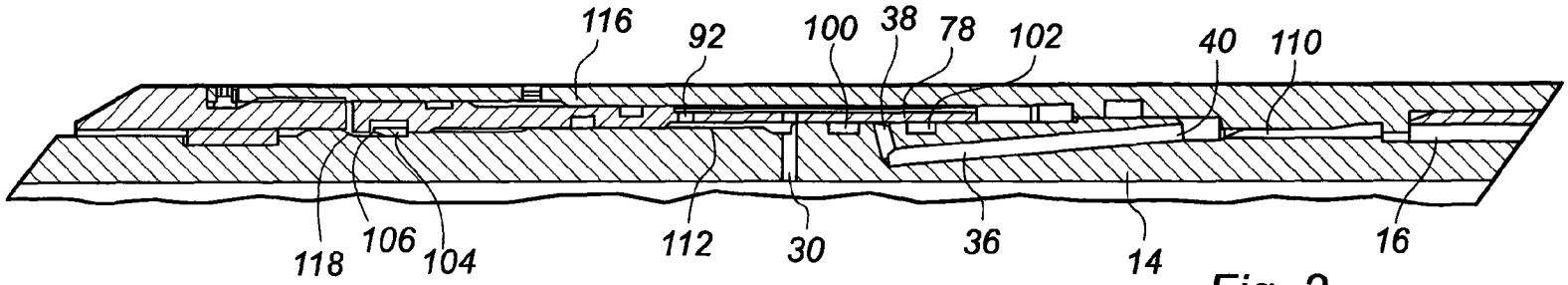
Figures 3A, 3B, 3C:
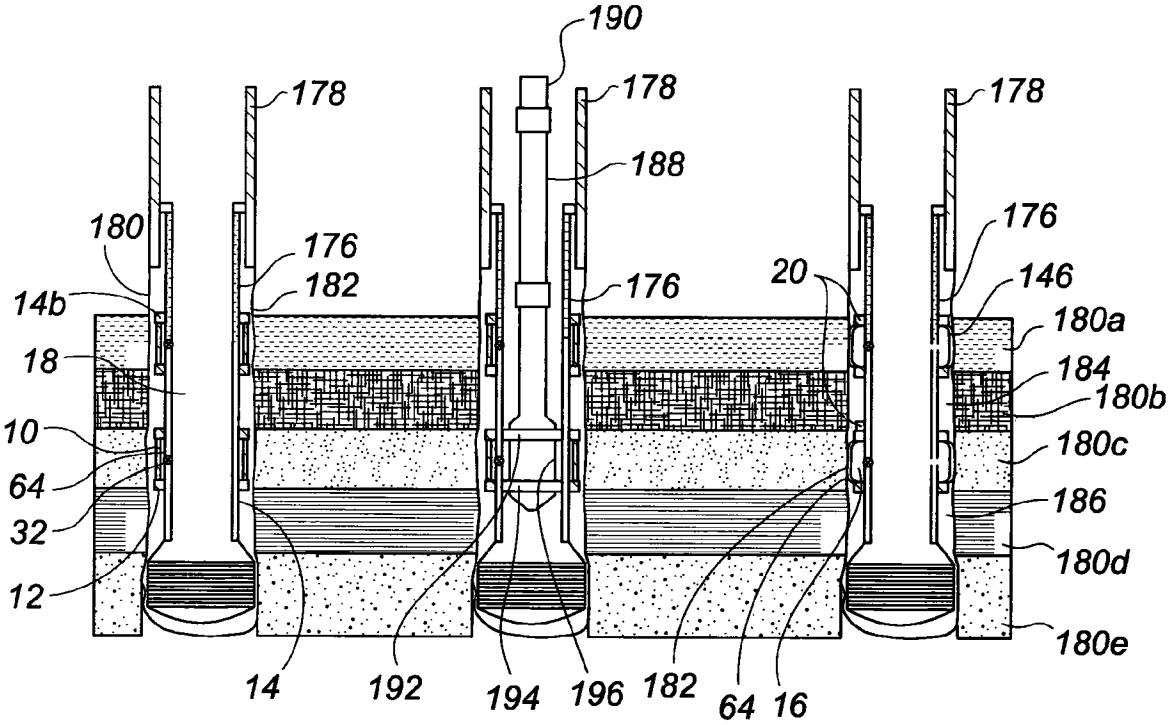

Embodiments of the present invention will now be described, by way of example only, with reference to the accompanying drawings of which:

FIG. 1 is a cross-sectional view through a downhole assembly in a first configuration according to an embodiment of the present invention;

FIG. 2 is a cross-sectional view through the downhole assembly of FIG. 1 in a second configuration; and FIG. 3 is a schematic illustration of a sequence for setting two sleeve members in an open borehole where FIG. 3*a* is a cross-sectional view of a liner provided with two sleeve members; FIG. 3*b* shows the liner in the borehole of FIG. 3*a* with a hydraulic fluid delivery tool inserted therein; and FIG. 3*c* is a cross-sectional view of the liner of FIGS. 3*a* and 3*b* with morphed sleeves and pressure balanced chambers, in use.

Reference is initially made to FIG. 1 of the drawings which illustrates an assembly, generally indicated by reference numeral 10, including a fill mechanism 12 provided through a tubular body 14, to fill a chamber 16 with fluid from a throughbore 18 of the tubular body 14, according to an embodiment of the present invention.

Tubular body 14 is a cylindrical tubular section having at a lower end 20, a pin section (not shown) and at an upper end 22, a box section (not shown) for connecting the body 14 into a tubing string such as casing, liner or production tubing that is intended to be permanently set or completed in a well bore, as is known in the art. Body 14 has an inner surface 24 which forms the wall of the throughbore 18 and is co-linear with the throughbore of the string. Body 14 also has an outer surface 26 profiled to provide a number of functions.

Between the inner 24 and outer 26 surfaces of the body 14 is arranged a first fluid passageway 30. First fluid passageway 30 extends from a first port 32 on the inner surface 24 to a second port 34 on the outer surface 26. A second fluid passageway 36 is also arranged through the body 14 to provide a conduit between a third port 38 on the outer surface 26 and a fourth port 40, also arranged on the outer surface 26. To achieve the second fluid passageway 36 travelling between two points, ports 38,40 on the outer surface 26, two conduits 42,44 are drilled into the body 14 from each port 38,40 respectively. The conduits are angled to meet at a point 46 in the body 14 where the direction of the second fluid passageway 36 turns. The second 34, third 38 and fourth 40 ports are spaced longitudinally along the outer surface 26 from the upper end 22 to the lower end 20.

Towards the upper end 22 there is a stop 48 being a ring located around the body 14 and attached thereto. At the upper end 50 of the stop 48, the face 52 is sloped while the opposing face has two abutting surfaces 54,56. These surfaces 54,56 are perpendicular to the longitudinal, central axis of the throughbore 18. Abutting the first surface 54 is lower end 58 of an outer sleeve 60. Outer sleeve 60 is arranged around the body 14, extending over the ports 34,38,40 to the chamber 16. In an embodiment, the outer sleeve 60 forms part of a fastening 62 to hold a morphable sleeve 64 to the body 14 with the chamber 16 being located between the morphable sleeve 64 and the outer surface 26 of the body 14.

The outer sleeve 60 has a profiled inner surface 66. On the surface 66 is an upwardly facing abutting surface 68 arranged between the third 38 and fourth 40 ports. This abutting surface 68 of the outer sleeve 60 together with the downwardly facing abutting surface 56 of the stop 48, the outer surface 26 of the body 14 and the inner surface 66 of the outer sleeve 60 define a housing 70. The second 34 and third 38 ports access the housing 70. Located in the housing 70 is a piston 72. In the embodiment of FIG. 1, the piston 72 is a sleeve located around the body 14. Piston 72 has a length which is shorter than the distance between the abutting surfaces 56,68 of the housing 70, so that the piston 72 can move longitudinally with respect to the body 14. A shear pin 74, provides retaining means to initially hold the piston 72 in a position wherein its lower end face 76 abuts the surface 68. The shear pin 74 is located between the piston 72 and the outer sleeve 60. This arrangement of the piston 72 at the lower end of the housing 70 and retained by the shear pin 74, is referred to as the first configuration.

The lower end 78 of the piston 72 is narrower than an upper end 80 and the housing 70 is sized at its lower end 82, to provide a sliding fit to the piston 72. The lower end 82 of the housing 70 extends from the downward side of the second port 34 to the abutting surface 68. A seal 84 is arranged between the inner surface 86 of the piston 72 and the outer surface 26 of the body 14. A seal 88 is also arranged between the outer surface 90 of the piston 72 and the inner surface 66 of the outer sleeve 60. Seals 84,88 are located so as to isolate the lower 78 and upper 80 ends of the piston 72 in the housing 70.

The piston 72 has two apertures 92,94 through the lower end 78. The apertures 92,94 are spaced apart longitudinally and substantially align with the second 34 and third 38 ports when the assembly 10 is in the first configuration. At the second port 34, a recess 96 is provided in the body 14 so that fluid can flow from the passageway 30 into the aperture 92 when the aperture 92 is located over the recess 96. As the outer surface 90 of the piston 72 runs against the inner surface 66 of the outer sleeve 60, a channel 98 is provided longitudinally in the outer surface 90 of the piston 72. Channel 98 provides a flow path connecting the first aperture 92 with the second aperture 94 and extending to the lower end face 78 of the piston 72.

Seals 100,102 are arranged on the outer surface 26 of the body 14 at either side of the third port 38. Each seal 100,102 is positioned circumferentially around the body 14 to prevent the flow of fluid between the inner surface 86 of the piston 72 and the outer surface 26 of the body 14 along the lower end 82 of the housing 70.

At the upper end 80 of the piston 72 there is arranged a snap-ring 104 located in a recess on the inner surface 86. A recess 106 is provided on the outer surface 26 of body 14 at the upper end 108 of the housing 70 into which the snap-ring 104 can locate when the piston 72 moves to the lower end 108 of the housing 70. Recess 106 has a depth such that the snap-ring 104 will locate partially therein to lock the piston 72 to the body 14.

At the fourth port 40, the inner surface 66 of the outer sleeve 60 and the outer surface 26 of the body 14 are profiled to provide a fluid flow passageway 110 from the fourth port 40 to the chamber 16. The passageway 110 separates the fill mechanism 12 from the chamber 16 by longitudinally spacing the fill mechanism 12 from the chamber 16.

While a single flow path between the throughbore 18 and the chamber 16 has been described, it will be appreciated that any number of flow paths may be incorporated in the mechanism 12. Multiple ports 32 could be arranged circumferentially through the body 14, with a sleeve or multiple individual pistons 72 arranged at the exit port 34. Any number of channels 98 could be arranged around the sleeve with an end gully provided to connect them all around the outer surface 90 of the piston 72. Equally, multiple passageways 36 could be provided and a series of parallel arranged channels 110 on the outer surface 26 of the body 14 could direct fluid through multiple ports into the chamber 16.

As described hereinbefore, in an embodiment, the outer sleeve 60 forms part of a fastening 62 to hold a morphable sleeve 64 to the body 14 with the chamber 16 being located between the morphable sleeve 64 and the outer surface 26 of the body 14. The morphable sleeve 64 is located around a portion of the tubular body 14 with the body 14 located coaxially within the morphable sleeve 64. Morphable sleeve 64 is a steel cylinder being formed from typically 316L or Alloy 28 grade steel but could be any other suitable grade of steel or any other metal material or any other suitable material which undergoes elastic and plastic deformation. The morphable sleeve 64 is appreciably thin-walled of lower gauge than the tubing body 14 and is preferably formed from a softer and/or more ductile material than that used for the tool body 14. The morphable sleeve 64 may be provided with a non-uniform outer surface such as ribbed, grooved or other keyed surface in order to increase the effectiveness of the annular seal created by the morphable sleeve 64 when secured within another casing section or borehole.

An elastomer or other deformable material may be bonded to the outer surface of the morphable sleeve 64; this may be as a single coating but is preferably a multiple of bands with gaps therebetween.

In use, the assembly 10 is arranged on a string in the first configuration, shown in FIG. 1. Piston 72 is arranged as a sleeve over the tool body 14 and located against the lower face 68 of the housing 70. Stop 48 is positioned on and fixed to the body 14. Outer sleeve 60 is then placed over the body 14 to form the housing 70 of the fill mechanism 12. Alignment of the shear screw 74 will align the ports 34,38 with the apertures 92,94.

The assembly 10 is then run-in the well in the first configuration. A rupture disk may be located at the first port 32 to prevent any flow of fluid into the assembly 10 until desired. When the chamber 16 requires to be filled, fluid pressure at the first port 32 is increased. This increase in fluid pressure may be by increased pumping through the string or may be by running a setting tool to the location of the port 32 and delivering pressurised fluid to the port 32 via the tool. This process will be described herein with reference to FIG. 3.

Fluid flow into port 32 from the throughbore 18 will pass through passageway 30, exit at port 34 into recess 96 and enter aperture 92 in the piston 72. From the aperture 92 fluid will flow down the channel 98 to enter the third port 38 via aperture 94. Piston 72 is held in place by shear pin 74 so the piston 72 will not move. The presence of seals 84 and 88 ensures the fluid is therefore directed to the fourth port 40, through the second fluid passageway 36.

At the fourth port 40 there is an uninterrupted flow path through the passageway 110 into the chamber 16. The chamber 16 will therefore be filled with pressurised fluid from the throughbore 18. The chamber 16 will continue to fill until the pressure in the chamber 16 matches the shear rating on the shear pin 74. At this point, fluid acting on the between the seals 84,88 will be sufficient to shear the pin 74 and the piston 72 will move upwards in the housing 70.

Passageway 112 is shown in FIG. 2 of the drawings. Passageway 112 joins the second port 34 to the aperture 92 and will increase in size as the piston 72 is moved in the housing 70. This flow of fluid through the aperture 92 will travel through channel 98 and fill a lower housing chamber created by the separation of surfaces 76 and 68. As chamber fills, pressure on surface 76 will continue to move the piston 72 through the housing 70 towards the upper end 22. During movement the seals 84,88 on the piston remain sealed to the surfaces 26,66 of the outer sleeve 60 and body 14, respectively, to keep fluid within the lower end 82 of the housing 70.

As piston 72 moves upwards aperture 94 will move away from port 38 and the inner surface 86 of the piston 72 will slide over the port 38. Aperture 94 will pass over the seal 100 and consequently the passageway 36 is blocked, being sealed at the port 38 by the piston 72 acting as a sliding sleeve valve in the longitudinal direction, co-linear with the central axis. Debris is kept from the port 38 by the action of the sealing surface 78 being drawn across the seals 100,102. The sliding sleeve, piston 72, is contained within a housing 70 located between the inner surface 24 of the body 14 and the outer surface 116 of the outer sleeve 60. Sealing the port 38 contains fluid at a fixed pressure within the chamber 16.

To hold the piston 72 in the sealed position, the piston 72 is moved until the snap-ring 104 is free to move inwardly into the recess 106 on the body 14. Snap-ring 104 bridges between the body 14 and the piston 72 to prevent relative longitudinal movement therebetween. A stop 118 is also present in the housing to limit upward movement of the piston 72. In this position, as illustrated in FIG. 2, the assembly is considered as set, being in a second configuration.

The seal at port 38 can be maintained for the life of the well to hold the pressure of fluid in the chamber at a fixed value.

Reference will now be made to FIG. 3 of the drawings which provides an illustration of the method for expanding a morphable sleeve within a well bore according to an embodiment of the present invention. Like parts to those in the earlier Figures have been given the same reference numerals to aid clarity.

In use, the assembly 10 is conveyed into the borehole by any suitable means, such as incorporating the assembly 10 into a casing or liner string 176 or on an end of a drill pipe and running the string into the wellbore 178 until it reaches the location within the open borehole 180 at which operation of the assembly 10 is intended. This location is normally within the borehole at a position where the morphable sleeve 64 is to be expanded in order to, for example, isolate the section of borehole 180*b* located above the sleeve 64 from that below 180*d* in order to provide an isolation barrier between the zones 180*b*,180*d*. Additionally a further assembly 10*b* can be run on the same string 176 so that zonal isolation can be performed in a zone 180*b* in order that an injection, frac'ing or stimulation operation can be performed on the formation 180*b* located between the two sleeves 64, 64*a*. This is as illustrated in FIG. 3B.

Each sleeve 64,64*a* can be set by increasing the pump pressure in the throughbore 18 to a predetermined value which represents a pressure of fluid at the port 32 being the morphed pressure value. The morphed pressure value will be calculated from knowledge of the diameter of the body 14, the approximate diameter of the borehole 180 at the sleeve 64, the length of the sleeve 64 and the material and thickness of the sleeve 64. The morphed pressure value is the pressure sufficient to cause the sleeve 64 to move radially away from the body 14 by elastic expansion, contact the surface 182 of the borehole and morph to the surface 182 by plastic deformation.

When the morphed pressure value is applied at the port 32, a rupture disc, if installed at the port 32, will have burst as it is set below the morphed pressure value. The fill mechanism 12 is arranged to allow fluid from the throughbore 18 to enter the chamber 16 between the body 14 and the sleeve 64. This fluid will increase pressure in the chamber 16 so as to cause the sleeve 64 to move radially away from the body 14 by elastic expansion, contact the surface 182 of the borehole and morph to the surface 182 by plastic deformation. When the morphing has been achieved, a sealing surface 78 of a piston 72 in the fill mechanism 12 will close and trap fluid at a pressure equal to the morphed pressure value within the chamber 16.

The sleeve 64 will have taken up a fixed shape under plastic deformation with an inner surface 146 matching the profile of the surface 182 of the borehole 180, and an outer surface also matching the profile of the surface 182 to provide a seal which effectively isolates the annulus 184 of the borehole 180 above the sleeve 64 from the annulus 186 below the sleeve 64. If two sleeves 64,64*a* are set together then zonal isolation can be achieved for the annulus 184 between the sleeves 64,64*a*. At the same time the sleeves 64,64*a* have effectively centered, secured and anchored the tubing string 176 to the borehole 180.

An alternative method of achieving morphing of the sleeve 64 is shown in FIG. 3B. This method uses a hydraulic fluid delivery tool 188. Once the string 176 reaches its intended location, tool 188 can be run into the string 176 from surface by means of a coiled tubing 190 or other suitable method. The tool 188 is provided with upper 192 and lower 194 seal means, which are operable to radially expand to seal against the inner surface 24 of the body 14 at a pair of spaced apart locations in order to isolate an internal portion of body 14 located between the seals 192,194. It should be noted that said isolated portion includes the fluid port 32. Tool 188 is also provided with an aperture 196 in fluid communication with the interior of the string 176.

To operate the tool 188, seal means 192 are actuated from the surface to isolate the portion of the tool body 14. Fluid, which is preferably hydraulic fluid, is then pumped under pressure, which is set to the morphed pressure value, through the coiled tubing such that the pressurised fluid flows through tool aperture 196 and then via port 32 into chamber 16 and acts in the same manner as described hereinbefore.

A detailed description of the operation of such a hydraulic fluid delivery tool 188 is described in GB2398312 in relation to the packer tool 112 shown in FIG. 27 with suitable modifications thereto, where the seal means 92 could be provided by suitably modified seal assemblies 214, 215 of GB2398312, the disclosure of which is incorporated herein by reference. The entire disclosure of GB2398312 is incorporated herein by reference.

Using either pumping method, the increase in pressure of fluid directly against the sleeve 64 causes the sleeve 64 to move radially outwardly and seal against a portion of the inner circumference of the borehole 180. The pressure within the chamber 16 continues to increase such that the sleeve 64 initially experiences elastic expansion followed by plastic deformation. The sleeve 64 expands radially outwardly beyond its yield point, undergoing plastic deformation until the sleeve 64 morphs against the surface 182 of the borehole 180 as shown in FIG. 3C. Accordingly, the sleeve 14 has been plastically deformed and morphed by fluid pressure without any mechanical expansion means being required.

When the morphing has been achieved, the shear pin 74 will shear and the sliding sleeve 72 will move across and close the port 38 to the chamber 16, as described hereinbefore. Closure of the port 38 will close and trap fluid at a pressure equal to the morphed pressure value within the chamber 16. The sliding sleeve 72 is held over the port 38 so that the fluid cannot escape from the chamber 16 and the sleeve 64 will remain morphed against the borehole wall 182.

As the sealing surface 78 travels over seals 100,102 debris cannot be trapped at the port 38 and the valve created will close fully without any leakage or loss of pressure for the life of the well.

The principle advantage of the present invention is that it provides a downhole assembly with a fill mechanism which provides a sliding seal on an outer surface of a tool body to contain fluid in a chamber which increases collapse rating and can be operated by fluid flow in the throughbore.

A further advantage of the present invention is that it provides a method of expanding a morphable sleeve in a well bore which provides a sealed chamber at a desired pressure to maintain the sleeve in the morphed position and expansion of the sleeve can be achieved by merely increasing pressure in the throughbore.

A yet further advantage of the present invention is that it provides a downhole assembly with a fill mechanism in which the sealing surface is contained within a housing located at an outer surface of the tool body so that no connections or parts are required in the throughbore.

A yet further advantage of the present invention is that it provides a downhole assembly with a fill mechanism in which the fill mechanism is located adjacent the chamber on the assembly so that the assembly can be thin walled to maintain a large throughbore.

It will be apparent to those skilled in the art that modifications may be made to the invention herein described without departing from the scope thereof. For example, the fill mechanism may be arranged at one or both sides of the chamber. The fill mechanism may be arranged to fill more than one chamber.

I claim:

1. A downhole assembly, the assembly comprising a tubular body being a cylindrical tubular section with a cylindrical throughbore and having an inner surface and an outer surface, the inner surface being the wall of the throughbore, a chamber at the outer surface of the body and a fill mechanism to control fluid flow between the throughbore and the chamber, the fill mechanism comprising:

a first fluid passageway being a conduit through the tubular body between a first port at the inner surface of the tubular body and a second port at the outer surface of the tubular body; a second fluid passageway, said second fluid passageway being non-intersecting with the first fluid passageway within said tubular body and thereby independent of the first fluid passageway, comprising two conduits in the tubular body, each of said two conduits positioned at an angle to said outer surface and meeting within said tubular body, creating a turn within said second fluid passageway, said second fluid passageway thereby forming a conduit through the tubular body between a third port at the outer surface of the tubular body and a fourth port at the outer surface of the tubular body, the second, third and fourth ports being spaced apart longitudinally on the outer surface of the tubular body;

and a housing located on the outer surface, the housing containing a piston, the piston including a sliding seal at the outer surface, the sliding seal having a sealing surface to provide a seal on the outer surface, the second and third ports exit into the housing;

the fourth port provides a flow path to the chamber;

and wherein in a first configuration, fluid flows from the throughbore to the chamber by flow through the housing from the second port to the third port and via the second fluid passageway to exit the fourth port and fill the chamber; and in a second configuration the sealing surface seals the third port to prevent fluid flow to the chamber, the fill mechanism switching from the first configuration to the second configuration when fluid pressure in the chamber reaches a preselected fluid pressure, the preselected fluid pressure being sufficient to cause movement of the piston in the housing and thereby seal the chamber at the preselected fluid pressure, wherein the housing is formed in a sleeve around the tubular body.

2. A downhole assembly according to claim 1 wherein the sealing surface is co-linear with a central, longitudinal axis of the tubular body.

3. A downhole assembly according to claim 1 wherein the fourth port exits directly into the chamber.

4. A downhole assembly according to claim 1 wherein there is a third fluid passageway from the fourth port to the chamber.

5. A downhole assembly according to claim 1 wherein the sliding seal moves between the first configuration and the second configuration by the action of fluid pressure against an end surface of the sliding seal.

6. A downhole assembly according to claim 1 wherein the fill mechanism includes retaining means to hold the sliding seal in the first configuration.

7. A downhole assembly according to claim 6 wherein the retaining means is a shear pin.

8. A downhole assembly according to claim 1 wherein the fill mechanism includes locking means to keep the sliding seal in the second configuration.

9. A method of morphing a sleeve in a well, comprising the steps:

(a) mounting a downhole assembly on a tubular string, the assembly comprising a tubular body being a cylindrical tubular section with a cylindrical throughbore and having an inner surface and an outer surface, the inner surface being the wall of the throughbore, a chamber at the outer surface of the body and a fill mechanism to control fluid flow between the throughbore and the chamber, the fill mechanism comprising:

a first fluid passageway being a conduit through the tubular body between a first port at the inner surface of the tubular body and a second port at the outer surface of the tubular body; a second fluid passageway comprising two conduits in the tubular body, each of said two conduits positioned at an angle to said outer surface and meeting within said tubular body, creating a turn within said second fluid passageway, said second fluid passageway thereby forming a conduit through the tubular body between a third port at the outer surface of the tubular body and a fourth port at the outer surface of the tubular body, said second fluid passageway being non-intersecting with said first fluid passageway within said tubular body, the second, third and fourth ports being spaced apart longitudinally on the outer surface of the tubular body;

and a housing is located on the outer surface, the housing containing a piston, the piston including a sliding seal at the outer surface, the sliding seal having a sealing surface to provide a seal on the outer surface, wherein the housing is formed in a sleeve around the tubular body, the second and third ports exit into the housing;

the fourth port provides a flow path to the chamber;

and wherein in a first configuration, fluid flows from the throughbore to the chamber by flow through the housing from the second port to the third port and via the second fluid passageway to exit the fourth port and fill the chamber; and in a second configuration the sealing surface seals the third port to prevent fluid flow to the chamber, and wherein the fill mechanism is longitudinally spaced from the chamber and the chamber is formed between a morphable sleeve and the outer surface of the tubular body;

(b) retaining the sliding seal in the first configuration to provide a fluid flow path between the throughbore and the chamber wherein fluid flows in the first port and exits the fourth port to fill the chamber;

(c) running the assembly on the tubing string into a well;

(d) increasing fluid pressure in the throughbore to fill the chamber;

(e) using the fluid in the chamber to radially move the morphable sleeve away from the tubular body and morph to a wall in the well bore creating an annular seal between the tubular string and the wall;

(f) releasing the sliding seal at a preselected fluid pressure;

(g) moving the sliding seal longitudinally over the outer surface of the body to seal the third port to prevent fluid flow to the chamber, thereby switching the fill mechanism from the first configuration to the second configuration when fluid pressure in the chamber reaches the preselected fluid pressure;

(h) locking the sliding seal in the second configuration to seal the chamber at the preselected fluid pressure; and (i) maintaining the annular seal to prevent fluid flow past the assembly between the tubular string and the wall of the well bore.

* * * * *